United States Patent [19]

Krevet

[11] Patent Number: 4,902,993

[45] Date of Patent: Feb. 20, 1990

[54] MAGNETIC DEFLECTION SYSTEM FOR CHARGED PARTICLES

[75] Inventor: Berthold Krevet, Dettenheim, Fed. Rep. of Germany

[73] Assignee: Kernforschungszentrum Karlsruhe GmbH, Fed. Rep. of Germany

[21] Appl. No.: 290,259

[22] PCT Filed: Feb. 18, 1988

[86] PCT No.: PCT/DE88/00079

§ 371 Date: Dec. 14, 1988

§ 102(e) Date: Dec. 14, 1988

[87] PCT Pub. No.: WO88/06394

PCT Pub. Date: Aug. 25, 1988

[30] Foreign Application Priority Data

Feb. 19, 1987 [DE] Fed. Rep. of Germany ..... 3705294

[51] Int. Cl.[4] ..... H01F 7/00

[52] U.S. Cl. ..... 335/210; 335/213

[58] Field of Search ..... 335/210, 213, 299

[56] References Cited

U.S. PATENT DOCUMENTS 4,680,565 7/1987 Jahnke ..... 335/299

4,769,623 9/1988 Marsing et al. ..... 335/299 X

FOREIGN PATENT DOCUMENTS 0208163 1/1987 European Pat. Off. .

2318507 10/1974 Fed. Rep. of Germany .

2341922 9/1977 France .

OTHER PUBLICATIONS

J. E. Draper: "Beam Sterring with Quadrupole and with Rectangular Box Magnets", Oct. 1966, pp. 1390–1394.

T. E. Wood: "High Magnetic Field Techniques for Neutron and X-Ray Scattering", Sep. 1984, pp. 685–690.

W. Heinz: "Research Work on Superconducting Magnet Systems in Germany", Mar. 1975, pp. 148–153.

*Primary Examiner*—George Harris

*Attorney, Agent, or Firm*—Spencer & Frank

[57] ABSTRACT

A magnetic deflection system for charged particles, the which includes a coil arrangement for generating a magnetic guide field perpendicular to the plane of the desired orbit so as to guide the particles in the plane $S_E$ of the desired orbit on a deflection path on a deflection radius $r_0$. The system has two coils which are arranged on top of one another on either side of an area $A_0$ defined by the direction of the magnetic guide field and the deflection radius $r_0$ so that the winding faces of the coils extend parallel to area $A_0$, with two of the coils being disposed above the plane $S_E$ of the desired orbit and two below the plane $S_E$ of the desired orbit.

In a preferred embodiment, the coils are composed of at least one double pancake.

2 Claims, 3 Drawing Sheets

MAGNETIC DEFLECTION SYSTEM FOR CHARGED PARTICLES

FIELD OF THE INVENTION

The invention relates to a magnetic deflection system for charged particles.

TECHNOLOGY REVIEW

To guide particle beams on circular orbits, particularly in a synchrotron or mass spectrometer, it is necessary to have high magnetic field intensities which are generated by specially shaped bending magnets.

The deflection radius $r_0$ is a function of the particle pulse $\vec{p}$ and of the magnetic field $\vec{B}$. The following applies:

$$r_0 = \frac{p}{q \cdot B}$$

where q is the charge of the particle.

With a given particle pulse, small deflection radii $r_0$ are produced with the largest possible magnetic fields. However, iron magnets have a technically realizable limit at 1.8 T. Higher fields can be realized with superconductive coils.

Details of the configuration and operation of such deflection systems are disclosed, for example, in the publication entitled "Entwurf einer Synchrotronstrahlungsquelle mit supraleitenden Ablenkmagneten für die Mikrofertigung nach dem LIGA-Verfahren" [Design of a Synchrotron Radiation Source Equipped With Superconductive Deflection Magnets For Microproduction According To The LIGA Method], KfK 3976, September 1985, ISSN 0303-4003. This publication describes coil concepts for superconductive deflection magnets in which the magnetic guide field perpendicular to the plane of the desired orbit is generated by means of coils whose winding faces are disposed parallel to the plane of the desired orbit. The winding faces have two long sides parallel to the particle orbit and two short sides which cross the particle orbit. The required magnetic field is generated by electrical currents extending parallel to the particle orbit. The currents crossing the particle orbit produce excessive fields and field distortions which cause intensive interference in the orbit. This effect is greater the closer the winding packets are broght to the particle orbit. These interferences in the orbit are reduced in that the winding regions crossing over the particle orbit are brought away from the plane of the desired orbit. This results in complicated coil geometries and considerable manufacturing problems, particularly with the use of superconductors. Superconductive coils are produced according to the pre-tensioning principle in order to prevent conductor movement which is one of the causes of quench. In the prior art coils here under consideration, a conductor enclosing the winding face passes through an outer radius $>r_0$ and an inner radius $<r_0$, with $r_0$ representing the deflection radius. When the coil is wound, no pretension can be applied in the region of the inner radius. Consequently, the pretensioning must be effected by clamping around the coil system. However, a synchrotron requires an arrangement in which the generated synchrotron light in the plane of the particle orbit is able to tangentially exit the magnet system. Consequently only those clamps must be employed which do not completely surround the coil system.

Such clamping elements are disclosed in German Patent No. 3,511,282. It describes a superconductive magnet system for particle accelerators of a synchrotron radiation source in which the winding faces of the coils are arranged parallel to the plane of the desired orbit and the windings cross the particle orbit.

SUMMARY OF THE INVENTION

It is an object of the invention to provide a magnet design for the above-mentioned magnetic deflection system which can be realized with a reduction of structural expenditures and facilitates the use of superconductive coils by its simple manufacturing technique.

The present invention provides magnetic deflection system for charged particles, which includes a coil arrangement for generating a magnetic guide field perpendicular to the plane of the desired orbit so as to guide the particles in the plane $S_E$ of the desired orbit on a deflection path on a deflection radius $r_0$. The system has at least two coils which are arranged on top of one another on either side of an area $A_0$ defined by the direction of the magnetic guide field and the deflection radius $r_0$ so that the winding faces of the coils extend parallel to area $A_0$, with at least two of the coils being disposed above the plane $S_E$ of the desired orbit and two below the plane $S_E$ of the desired orbit.

In a preferred embodiment, the coils are composed of at least one double pancake.

The advantages realized by the coil arrangement according to the invention are essentially that the coils can be manufactured according to the pre-tensioning principle in that the conductor is wound with tension according to conventional technology and at the ends of the magnets the winding packets are not brought across the particle orbit. Additionally, a sufficiently large gap is available to bring out the synchrotron radiation without having to relinquish the use of clamps unless such clamps would be superfluous in any case due to the winding technique employed.

The invention will be described below with reference to an embodiment and FIGS. 1 to 3.

DESCRIPTION OF THE PREFERRED EMBODIMENTS

Figure 1:
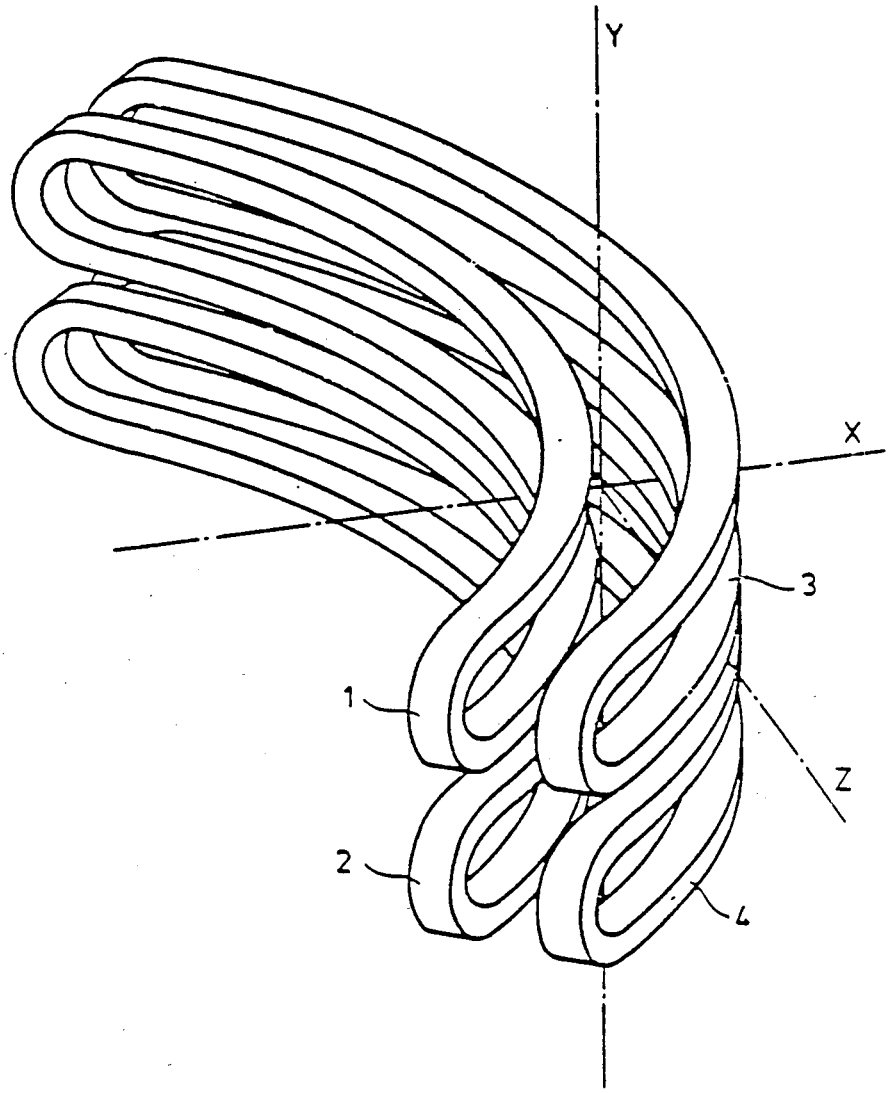
FIG. 1 is a three-dimensional illustration of a magnet system composed of four coils.

According to FIG. 1, the magnetic deflection system is composed of four coils 1, 2, 3, 4 whose spatial arrangement can be seen when referring to the drawn (x,y,z)-coordinate system. The plane $S_E$ of the desired orbit lies in the (x,z)-plane in which the deflection path changes coordinates between the coils and parallel to the coils. The winding faces which have a curvature $r \gtrsim r_0$ adapted to the desired orbit are oriented perpendicular to the plane $S_E$ of the desired orbit.

Figure 2:
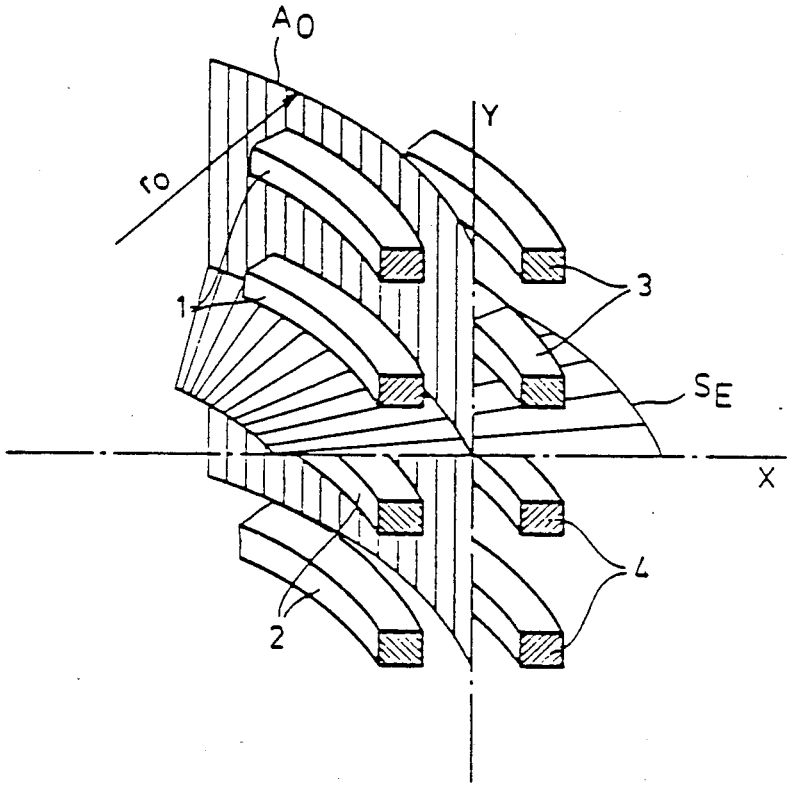
FIG. 2 is a sectional view in the (x,y)-plane of FIG. 1.

FIG. 2 is a sectional view of the coil system in the (x,y)-plane. The area $A_0$ defined by the magnetic guide field and the deflection radius $r_0$ is shown schematically and perpendicularly and intersects the plane $S_E$ of the desired orbit in the (x,z)-plane. On both sides of area $A_0$, coils 1, 2, 3, 4 are arranged in such a manner that they do not intersect area $A_0$. The winding faces of coils 1, 2, 3, 4 may be parallel as shown here or also oriented at an angle with respect to area $A_0$.

Figure 3:
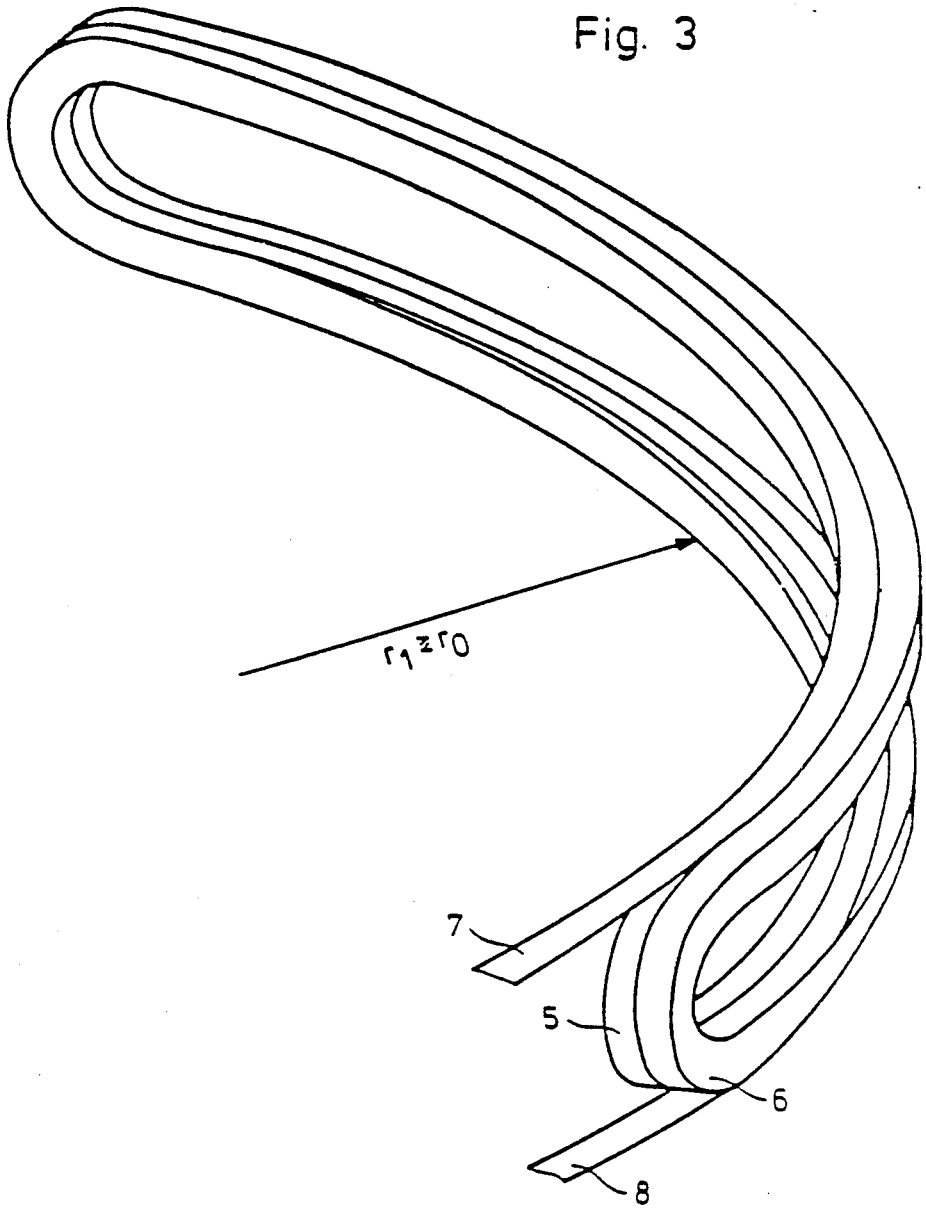
FIG. 3 is a coil packet composed of a double pancake.

FIG. 3 shows a winding of the deflection system composed of a double pancake. This is a winding technique which is employed with preference in the manufacture of superconductive windings. Initially, a winding disc 5 having a smaller radius of curvature $r_1 \geq r_0$ is produced and supports during the winding process a second winding disc 6 having a radius of curvature $r_2 > r_1$. The conductor can always be wound with tension. As required, several double pancakes may be connected in series to form a winding packet. The conductor ends 7, 8, which are always disposed at the largest winding diameter, facilitate the establishment of connections between the double pancakes. With this type of coil, the conductor may also be processed under tension according to any other winding technique.

I claim:

1. Magnetic deflection system for charged particles, the system including a coil arrangement for generating a magnetic guide field perpendicular to the plane of the desired orbit so as to guide the particles in the plane $S_E$ of the desired orbit on a deflection path on a deflection radius $r_0$, characterized in that at least two coils are arranged on top of one another on either side of an area $A_0$ defined by the direction of the magnetic guide field and the deflection radius $r_0$ so that the winding faces of the coils extend parallel to area $A_0$, with at least two of the coils being disposed above the plane $S_E$ of the desired orbit and two below the plane $S_E$ of the desired orbit.

2. Magnetic deflection system according to claim 1, characterized in that the coils are composed of at least one double pancake.

* * * * *